United States Patent [19]

Förster et al.

[11] Patent Number: 4,510,867

[45] Date of Patent: Apr. 16, 1985

[54] CONTROL SYSTEM FOR INK ZONE ADJUSTERS

[75] Inventors: Karl-Heinz Förster, Dresden; Helmut Schuck, Coswig; Hans Johne, Radebeul; Arndt Jentzsch, Coswig, all of German Democratic Rep.

[73] Assignee: VEB Kombinat Polygraph "Werner Lamberz" Leipzig, Leipzig, German Democratic Rep.

[21] Appl. No.: 558,852

[22] Filed: Dec. 7, 1983

[30] Foreign Application Priority Data

Dec. 8, 1982 [DD] German Democratic Rep. ..... 245693

[51] Int. Cl.[3] ..... B41F 31/04; B41L 27/04

[52] U.S. Cl. ..... 101/365; 101/DIG. 26

[58] Field of Search ..... 101/365, 350, 207, 208, 101/181, 148, DIG. 26; 364/131, 132, 138, 139

[56] References Cited

FOREIGN PATENT DOCUMENTS 2024457 1/1980 United Kingdom ..... 101/365

*Primary Examiner*—J. Reed Fisher

*Attorney, Agent, or Firm*—Michael J. Striker

[57] ABSTRACT

In a control system for a plurality of ink zone adjusters in a printing machine each adjuster is connected via a main control circuit and a first bidirectional address and data bus to an input and output unit where the measured data are stored on specific addresses to be retrieved for later use. An additional storage control circuit is connected to the first bidirectional data bus to provide an intermediate storage of the measured or retrieved data. The addtional storage control circuit includes an addressing circuit controlled by a program control circuit to apply addresses pertaining to individual printing units to corresponding storing circuits. These corresponding storing circuits are connected through the first bidirectional data bus via a processing circuit including a switching device controlled by the program control circuit to connect the additional storing circuits either directly, or via an adder or via a coder, so as to compensate for play in the mechanical components of the adjusters or to separate coarse and fine adjustment in the ink zones.

A recording-reading storing device is provided in the input and output unit, which is connected to a double four-contact switch interconnected between the main control circuit and the circuits connected to the position sensors and the setting motors of the respective ink zone adjusters. All the adjustment steps can be simulated on the recording-reading storing device and the ink zones can be adjusted without interferring with the printing process.

1 Claim, 2 Drawing Figures

CONTROL SYSTEM FOR INK ZONE ADJUSTERS

BACKGROUND OF THE INVENTION

The present invention relates to printing presses in general, and more particularly, to a control system for adjusting ductor blades in ink zones of individual printing units of the printing presses.

In the applicants' U.S. pending application Ser. No. 474,318 filed Mar. 10, 1983 a control system for ink zones of printing machines is disclosed, which is connected with the printing units of the machine, each unit having adjusters for the ink zones, having position setting motors, position sensors, and operation control units for printing units. The control system disclosed in the above application comprises a control circuit connected via a bidirectional address and data bus to an input/output unit, and an additional storing circuit connected to a first bidirectional address and data bus and consisting of a program control circuit, an addressing circuit assigned to respective printing units and connected to a program control circuit, a processing circuit connected to the program control circuit via the first bidirectional address and data bus, and a plurality of intermediate storing circuits assigned to respective printing units and connected at their inputs to the addressing circuit for the printing units and at their outputs, via a second bidirectional address and data bus, to the processing circuit, and the input/output unit including a semi-conductive random-access memory and a permanent memory, such as a magnetic tape storing device with a parallel-to-serial converter.

SUMMARY OF THE INVENTION

It is an object of the present invention to provide an improved control system for adjusting ductor blades in ink zones of individual printing units of the printing press.

It is a further object of the present invention to provide an additional control for ink zone-adjustment so that any selective modification of storing and retrieving signals would be undertaken, and in which the control system is provided with a plurality of selectively usable storing devices.

These and other objects of the invention are attained, by a control system in a printing machine for ink zone adjusters, which comprises position setting motors, position sensors, operation control circuit and a main control circuit which is connected via a first bidirectional address and data bus to an input/output unit, an input terminal control circuit connected to the position sensors, an output terminal control circuit connected to the position setting motors, an additional storage control circuit connected to said first bidirectional address and data bus and including a program control circuit cooperating with the main control circuit and with the operation control circuit, an addressing circuit controlled by the program control circuit, a processing circuit controlled by the program control circuit and connected to said first bidirectional address and data bus, a plurality of additional storing circuits assigned individually to corresponding printing units of the machine, and having their inputs connected to said addressing circuit and each being connected via a second bidirectional address and data bus and said processing unit to the first bidirectional address and data bus and therefrom to the input and output unit, the latter unit including a semiconductive read-only memory and a parallel-connected magnetic tape memory, a recording-reading storing device included in said input and output unit, and double switch having four contacts and connected to said main control circuit, the input of said recording-reading storing device being connected to a first contact of said double switch via an input address and data bus and the output of said recording-reading storing device being connected to a third contact of the double switch via an output address and data bus, said input terminal control circuit being connected to a fourth contact of said double switch and said output terminal control circuit being connected to a second contact of said double switch.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
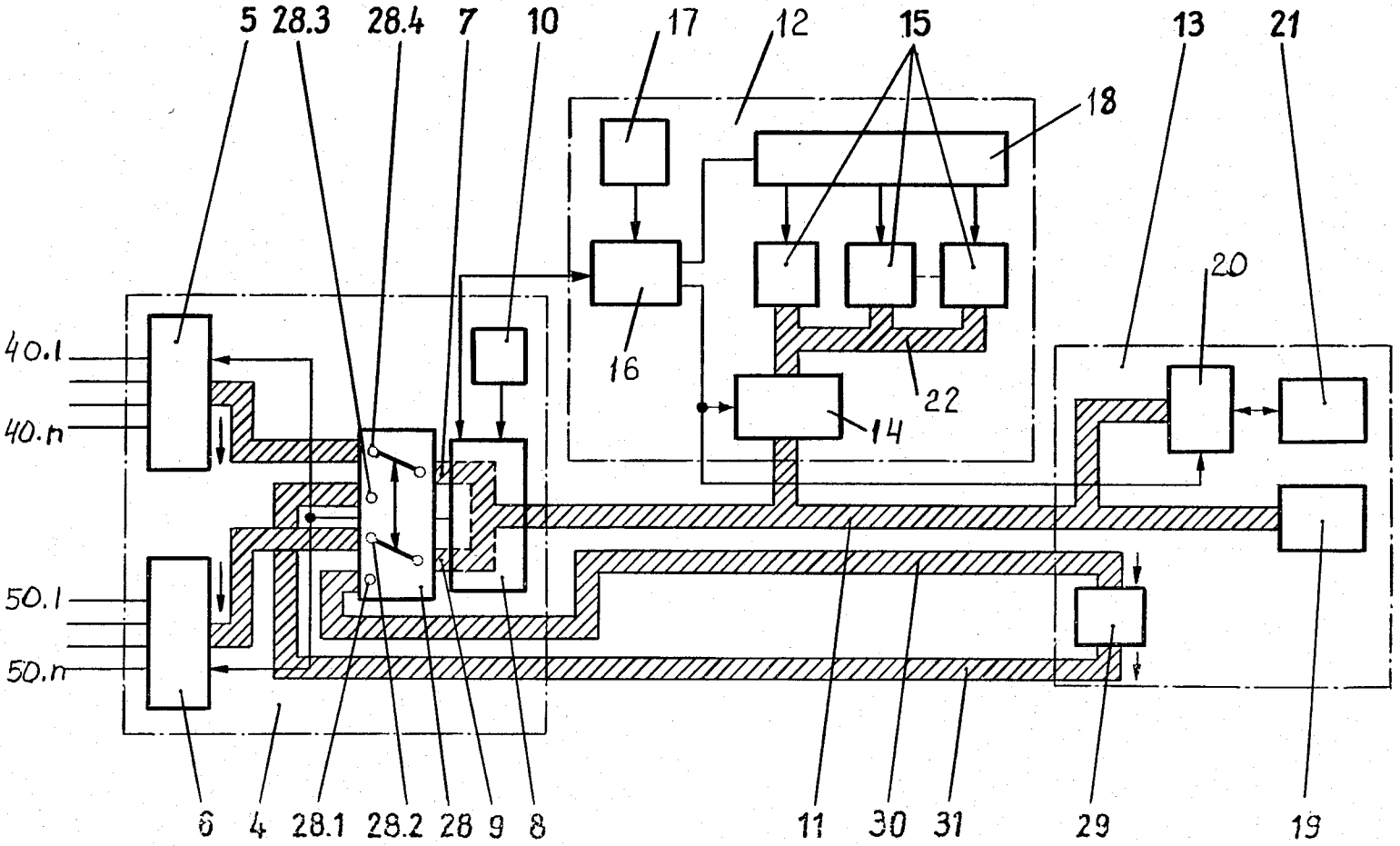
FIG. 1 is a block circuit diagram of a control system according to the present invention.

FIG. 1 illustrates an exemplified embodiment of the control system of the invention. The control system, shown in the FIG. 1 comprises a control block 4, an additional storing circuit 12 and an input-output unit 13.

The control block 4 described in detail in pending application Ser. No. 474,318 includes a main control circuit 8 which is connected to an input terminal control circuit 5 via a first unidirectional address and data bus 7 and to an output terminal control circuit 6 via a second unidirectional address and data bus 9.

The control block 4 further includes an operation control circuit 10 connected to the main control circuit 8.

The adjusters for the ink zones include in the conventional manner setting motors (not shown) to which conduits 50.1 to 50n, leading from the output terminal control circuit 6, are connected. Setting motors serve in the known fashion for actuating non-illustrated screws for adjusting the position of ductor blades. The input terminal control circuit 5 is, also in the conventional manner, connected, via conduits 40.1 to 40.n, to the position sensors known and thus not shown herein.

The control block 4 is connected to the additional storage control circuit 12 and to the input-output unit 13 via a first bidirectional address and data bus 11.

The input-output unit 13 includes a recording-reading storage device 29 in addition to a converter 20, magnetic tape storing device 21 and semiconductive memory device 19. The semiconductive memory device may be preferably in the form of a programmable read-only memory (PROM) or an electrically erasable PROM. The magnetic memory device 21 may be a tape recorder which is connected via the parallel-to-serial converter 20 to the first bidirectional address and data bus 11. The converter 20 is controlled by a program control unit 16 of the additional storage control circuit 12. The latter further includes an addressing circuit 18 connected to the output of the program control unit 16, on the one hand, and to a plurality of operational individual storage circuits for individual printing units 15, on the other hand, which circuits in turn are connected via a second bidirectional address and data bus 22 to a progressing circuit 14, the latter being connected to the first bidirectional data and address bus 11. The main control circuit 8 is connected to the input of the program control circuit 16, the other input of which is connected to a store 17 of the operation control circuit for the printing units.

Two unidirectional address and data bus lines 7 and 9 merge into the first bidirectional address and data bus line 11.

The main control circuit 8 is connected to two unidirectional address and data bus lines 7 and 9 via a double change over switch 28. The first contact 28.1 of the changeover switch 28 is connected to the recording-reading storing device 29 via an input address and data bus 30 whereas the third contact 28.3 of chargeover switch 28 is connected to the recording-reading storing device 29 via an output address and data bus 31. The second contact 28.2 of changeover switch 28 is connected with the output terminal control circuit 6 whereas the fourth contact 28.4 of changeover switch 28 is connected with the input terminal control circuit 5.

Figure 2:
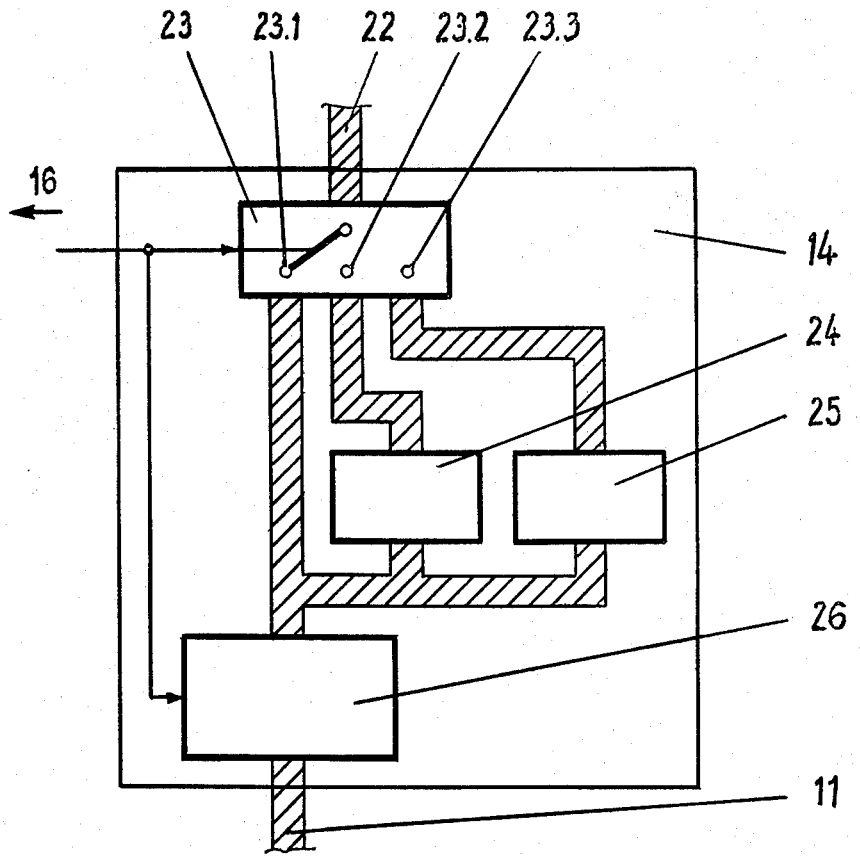
FIG. 2 is a block circuit diagram of a processing unit.

The processing unit shown in FIG. 2 comprises a three-position changeover switch 23 controlled by the program control unit 16 and has its input connected to the second bidirectional address and data bus 22, a gating circuit 26 connected to the first bidirectional address and data bus 7 and controlled by the program control circuit 16.

Reference numeral 24 denotes an adder and reference numeral 25 designates a coder. The gating circuit 26 is formed by known tri-state input and output ports. The address and data bus lines to adder 24 and coder 25 are unidirectional.

The first contact 23.1 of the switch 23 is directly connected via the second bidirectional address and data bus 22 to the gating circuit 26. The second and third contacts 23.2 and 23.3 of the switch 23 are connected to the input of the gating circuit 26 via the adder 24 and coder 25, respectively.

The addressing circuit 18, which is in the form of a multi-stage serial-padder shift register, is connected at its serial input to the program control circuit 16 and has the outputs of respective stages connected in parallel to the corresponding individual storing circuits 15 of individual printing units.

The input terminal control circuit 5 includes a series connection of an analog multiplexer and an analog/digital converter.

The output terminal control circuit 6 includes a conventional digital multiplexer which selects the individual motors and also includes a counter for counting the pulses applied to a motor and forming the setting data.

The additional control circuit 12 controls the printing units either in the storing mode of operation or retrieving mode of operation which are determined by the operation control storage circuit 17.

In the storing mode of operation, measured values detected by the position sensors (not shown but connected to the control system via conduits 40.1 to 40.n and assigned to respective ink zone setting screws) are stored in the input/output unit 13. To this end, the measuring values from the position sensors first pass through input terminal control circuit 5 and via the first unidirectional bus line 7 to the main control circuit 8 and therefrom via the first bidirectional address and data bus to the I/O unit 13.

The main control circuit 8 selects a predetermined address pertaining to the selected zone setting screw and delivers the same together with the measured data via the bidirectional bus 11 to the I/O unit 13 where the data are stored in the PROM 19 at the corresponding address. Simultaneously, the whole information, that is measuring data and the address pass through the parallel-to-serial converter 20 in the storing device 21.

The changeover from one printing unit to a selected another printing unit is made either manually in the operation control circuit 10 or automatically. The switchover of the printing units affects the addressing circuit 18 for the printing units.

The storing mode of operation is affected by the additional storage control circuit 12 which provides for an intermediate storing of the measured values. In this manner, the processing time is more effectively utilized.

In the first phase, the measured data from the first bidirectional address and data bus 11 are fed in the processing unit 14 including logic gating circuits controlled by the program control circuit 16. From the processing unit 14 the data and addresses reach via the second bidirectional address and data bus 22 the individual storing circuits 15, assigned to corresponding printing units. The selection of one of the storing circuits 15 is controlled by the addressing circuit 18, which in turn is controlled by the program control circuit 16. Along the same path, measured values stored in respective storing circuits 15 are fed via the gating circuit 26 of the processing circuit 14 and the bidirectional data bus 11 into the input-output unit 13.

In the retrieving mode of operation of the control system stored data are employed for adjusting the selected ink zone adjusting screws by controlling the setting motors (not shown and connected to the output terminal control circuit 6 via conduits 50.1 to 50.n) in the ink zone remote control adjuster including setting motors and adjustment sensors. These data stored in the semiconductive memory 19 or in the magnetic tape storage device 21 in the inpbt and output and output unit 13 are applied via the first bidirectional address and data bus 11 in the processing unit 14 of the additional storage control circuit 12 and therefrom to the individual storing or memory circuits 15. The data can be retrieved from the magnetic tape recording device 21 and is converted by the converter 20 in corresponding parallel information. From the additional storage control unit 12 the data are returned through the gating circuit 26 to the first bidirectional address and data bus 11 and applied in the main control unit 8 in the control block 4. From the main control circuit 8 the retrieved data are fed through the second unidirectional address and data bus 9 to the output terminal control circuit 6 controlled by the circuit 8 and therefrom the data are fed to the corresponding setting motors.

The setting data are related to a reference value and consequently before the initiation of the positioning process the individual setting motors are related to a standard reference position, such as a zero position. The adjustment to the zero position is made in a conventional manner by applying to all the setting motors an amount of pulses corresponding to the maximum setting position and applied in the direction of the zero position via the output terminal control circuit 6. In doing so, the counter in the circuit 6 is adjusted by the main control circuit 8 so as to replace the zero position. After completion of the zero positioning process, the ink zone screws are adjusted by means of the setting motors in accordance with the applied retrieved data.

The operation control circuit 10 includes means for manual changeover from one printing unit to another printing unit. This changeover if desired can be made automatically by suitable programming of the addressing circuit 18. In the case of manual changeover there is a possibility to modify arbitrarily the assignment of the setting values to respective printing units. For example, the setting values for a first printing unit can be applied from another storing circuit than that pertaining to the first printing unit. This changeover is effected in a conventional manner by switching voltages in the operational control unit 10.

The zero positioning of the setting motors is terminated in a known manner upon engaging a mechanical stop. When initiating the positioning process, due to the reversal of the motion, errors may occur due to the play in the mechanical component parts and due to misalignment of the rotors. In order to eliminate such positioning errors, it is possible by means of the additional storing control circuit to add to the retrieved setting data certain constant amount of setting pulses. For this purpose, the processing unit 14 is connected to the assigned storage circuits via the adder 24 or alternatively via coder 25. The gating circuit 26, as mentioned before, is controlled by the program controller 16 and is connected to the first bidirectional address and data bus 11. In the third position of switch 23, the coder 25 enables a separate coarse and fine adjustment of the setting motors. For the coarse adjustment, only the first part (tetrade) of a data byte is employed for the adjustment whereupon the remaining part of each byte is used for the fine adjustment. This data separation in the first and second tetrades is taken care of in a known manner by the coder 26. The addressing device 18 can have the form of a shift register controlled by series signals from the program control circuit 16. The individual stages of the shift register are connected to the storing circuit 15 for the individual printing units.

The improved control system of this invention, which includes the double switch 28 and the recording-reading storing device 29 in the input-output unit 13, operates as follows:

As has been mentioned above control block 4 serves for a manual adjustment of the setting motors with the aid of the operation control circuit 10 connected to the output terminal control circuit 6. The data for the standard reference position of the setting motors are issued parallel to each other via the second unidirectional address and data bus 9 so that a predetermined address corresponds to a predetermined setting motor. In the ideal situation, the first position returned from the position sensors connected to the input-output control circuit 5 via the first unidirectional address and data bus 7 corresponds to the standard reference position of the setting motors.

If the double switch 28 is inserted in the control and is connected via both unidirectional address and data bus lines 7 and 9 to the recording-reading storing device 29, then all adjustment steps can be simulated with this storing device and operation control unit 10. The recording-reading storing device 29 then operates as an imaginary printing unit. All the functions of the control system disclosed above can be carried out with the aid of the imaginary printing unit. This means that the position values fed to the imaginary printing unit can be selectively applied to the operational individual storage circuits 15, semiconductive memory device 19 or magnetic memory device (tape recorder) 21, without the necessity of intervening the machine control. Independently from the continuous printing process, new value applications corresponding to new printing parameters can be made before the initiation of the positioning process.

It will be understood that each of the elements described above, or two or more together, may also find a useful application in other types of ink zone control systems differing from the types described above.

While the invention has been illustrated and described as embodied in an ink zone control system for a printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. In a printing machine, a control system for ink zone adjusters including position setting motors, position sensors, operation control circuit and a main control circuit which is connected via a first bidirectional address and data bus to an input and output unit, an input terminal control connected to the position sensors, an output terminal control circuit connected to the position setting motors, an additional storage control circuit connected to said first bidirectional address and data bus and including a program control circuit cooperating with the main control circuit and with the operation control circuit, an addressing circuit controlled by the program control circuit, a processing circuit controlled by the program control circuit and connected to said first bidirectional address and data bus, a plurality of additional storing circuits assigned individually to corresponding printing units of the machine, and having their inputs connected to said addressing circuit and each being connected via a second bidirectional address and data bus and said processing unit to the first bidirectional address and data bus and therefrom to the input and output unit, the input and output unit including a semiconductive read-only memory and a parallel-connected magnetic tape memory, an improvement comprising a recording-reading storing device included in said input and output unit, and double switch having four contacts and connected to said main control circuit, the input of said recording-reading storing device being connected to a firt contact of said double switch via an input address and data bus and the output of said recording-reading storing device being connected to a third contact of the double switch via an output address and data bus, said input terminal control circuit being connected to a fourth contact of said double switch and said output terminal control circuit being connected to a second contact of said double switch.

* * * * *